United States Patent [19]

Becka

[11] 4,167,103

[45] Sep. 11, 1979

[54] MACHINE FOR ROUGHING THE MARGIN OF AN UPPER OF A SHOE ASSEMBLY

[75] Inventor: Michael M. Becka, Nashua, N.H.

[73] Assignee: International Shoe Machine Corporation, Nashua, N.H.

[21] Appl. No.: 926,673

[22] Filed: Jul. 21, 1978

[51] Int. Cl.[2] ..... C14B 1/44; A43D 0/00

[52] U.S. Cl. ..... 69/6.5; 12/1 R

[58] Field of Search ..... 69/6.5; 12/1 R, 1 A, 12/17 R, 17.2, 77, 88, 91, 92

[56] References Cited

U.S. PATENT DOCUMENTS

| | | | |
|---|---|---|---|
| 2,163,031 | 12/1964 | Kostell | 69/6.5 |
| 3,843,985 | 10/1974 | Leonhardt | 12/1 R |
| 3,975,932 | 8/1976 | Vornberger | 69/6.5 |
| 4,020,660 | 5/1977 | Bergeron | 69/6.5 |
| 4,090,378 | 5/1978 | Sommer | 69/6.5 |

*Primary Examiner*—Patrick D. Lawson
*Attorney, Agent, or Firm*—Albert Gordon

[57] ABSTRACT

A roughing machine having a support for supporting bottom-up a shoe assembly formed of a last having an insole located on its bottom and an upper mounted thereon with the margin of the upper secured to the bottom of the insole and a roughing tool located above the shoe assembly and yieldably urged downwardly against the shoe assembly so as to rough the upper margin during movement of the support to move the upper margin past the roughing tool. The shoe assembly bottom has its heel seat portion, its shank portion and its forepart portion lying in different planes. The support is so constructed as to be rockable in such a manner that the heel seat portion, the shank portion, and the forepart portion of the upper margin all lie in horizontal planes during their movement past the roughing tool.

3 Claims, 12 Drawing Figures

MACHINE FOR ROUGHING THE MARGIN OF AN UPPER OF A SHOE ASSEMBLY

BACKGROUND OF THE INVENTION

U.S. Pat. No. 4,090,378 shows a machine operative on a shoe assembly comprising a last having an insole located on its bottom on an upper mounted thereon with the margin of the upper secured to the bottom of the insole so that the upper margin and the insole form the bottom of the shoe assembly, the machine functioning to rough the upper margin. The shoe assembly bottom has spaced substantially planar end portions consisting of a heel seat portion and a forepart portion and a substantially planar shank portion between the two end portions, the three planar portions lying in different planes. The machine comprises: a support, for supporting the shoe assembly bottom-up, mounted for rocking movement through an upwardly concave arc; a roughing tool located above the shoe assembly; means for yieldably urging the roughing tool downwardly against the shoe assembly; and means for so moving the shoe assembly and means for so adjusting the position of the roughing tool that the upper margin from one end of the shoe assembly bottom to the other end of the shoe assembly bottom moves past the roughing tool and is roughed by the roughing tool with a first end portion, the shank portion, and the second end portion of the shoe assembly bottom moving past the roughing tool.

In the machine of U.S. Pat. No. 4,090,378, the shoe assembly support is initially rotated 180 degrees about a vertical axis to rotate a first end of the upper margin past the roughing tool, is then moved horizontally and linearly to move a side of the upper margin past the roughing tool, and is then again rotated 180 degrees about the vertical axis to rotate the second end of the upper margin past the roughing tool. During the linear horizontal movement, the shoe assembly support maintains the first end of the shoe assembly in a horizontal plane. During the horizontal linear movement of the shoe assembly support, the shoe assembly is so rocked through the upwardly concave arc that the second end of the shoe assembly lies in a horizontal plane during its rotation. The purpose of maintaining the two end portions of the shoe assembly in horizontal planes during their rotations is to ensure that the roughing tool engages the upper margin uniform distances inwardly of the outer periphery of the upper margin.

Due to the multi-planar construction of the shoe assembly bottom, portions of the shoe assembly bottom are sloping upwardly as they move past the roughing tool and other portions of the shoe assembly bottom are sloping downwardly as they move past the roughing tool. It is desirable that the upper margin be moved past the roughing tool at a uniform speed in order for the roughing tool to effect uniform roughing on the upper margin. However, with the roughing tool being yeildably urged downwardly against the upper margin, the passage of an upwardly sloped margin portion past the roughing tool tends to slow the movement of the upwardly sloped margin portion past the roughing tool and the passage of a downwardly sloped margin portion past the roughing tool tends to increase the rate of movement of the downwardly sloped margin portion past the roughing tool.

SUMMARY OF THE INVENTION

In order to provide uniform roughing of the upper margin and to overcome the deficiencies of the machine of U.S. Pat. No. 4090378 discussed in the preceding paragraph, the roughing machine of this invention has been improved by having the shoe assembly support movable through the upwardly concave arc between a first position in which the first end portion of the shoe assembly bottom lies in a substantially horizontal plane, a second position in which the shank portion of the shoe assembly bottom lies in a substantially horizontal plane, and a third position in which the second end portion of the shoe assembly bottom lies in a substantially horizontal plane. In order to have all portions of the upper margin lie in a substantially horizontal plane as they move past the roughing tool and thus ensure uniform roughing of the upper margin by the roughing tool, the machine of this invention comprises: means for initially retaining the support in the first position; means effective pursuant to movement of the support past the roughing tool when the juncture between the first end portion and the shank portion of the shoe assembly bottom is in registration with the roughing tool to move the support from its first position to its second position; and means effective pursuant to movement of the support past the roughing tool when the juncture between the shank portion and the second end portion of the shoe assembly bottom is in registration with the roughing tool to move the support from its second position to its third position.

DESCRIPTION OF THE PREFERRED EMBODIMENT

Figure 1:
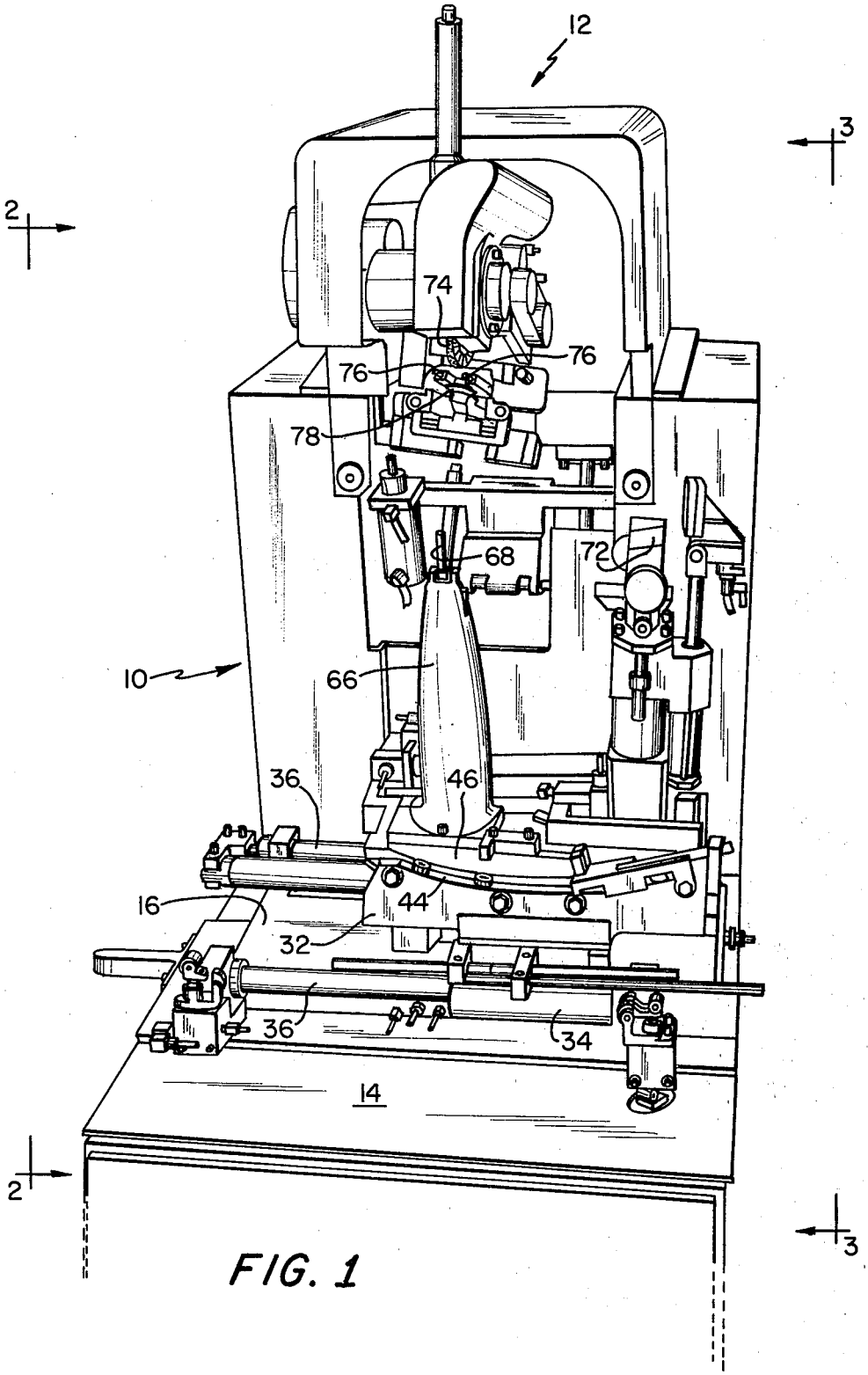
FIG. 1 is a front elevation of the machine.
Figure 2:
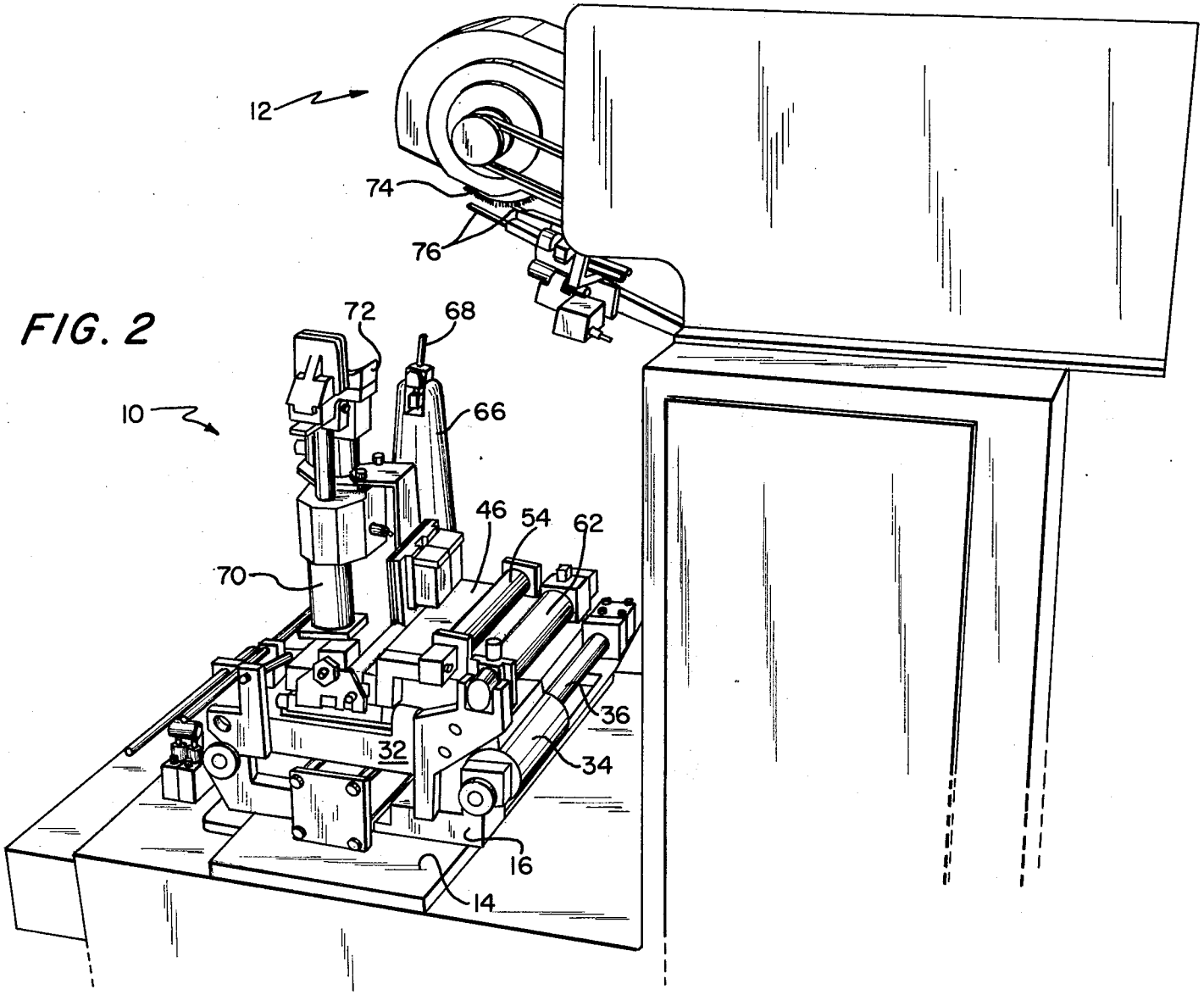
FIGS. 2 and 3 are side elevations of the machine respectively taken along lines 2—2 and 3—3 of FIG. 1.
Figure 3:
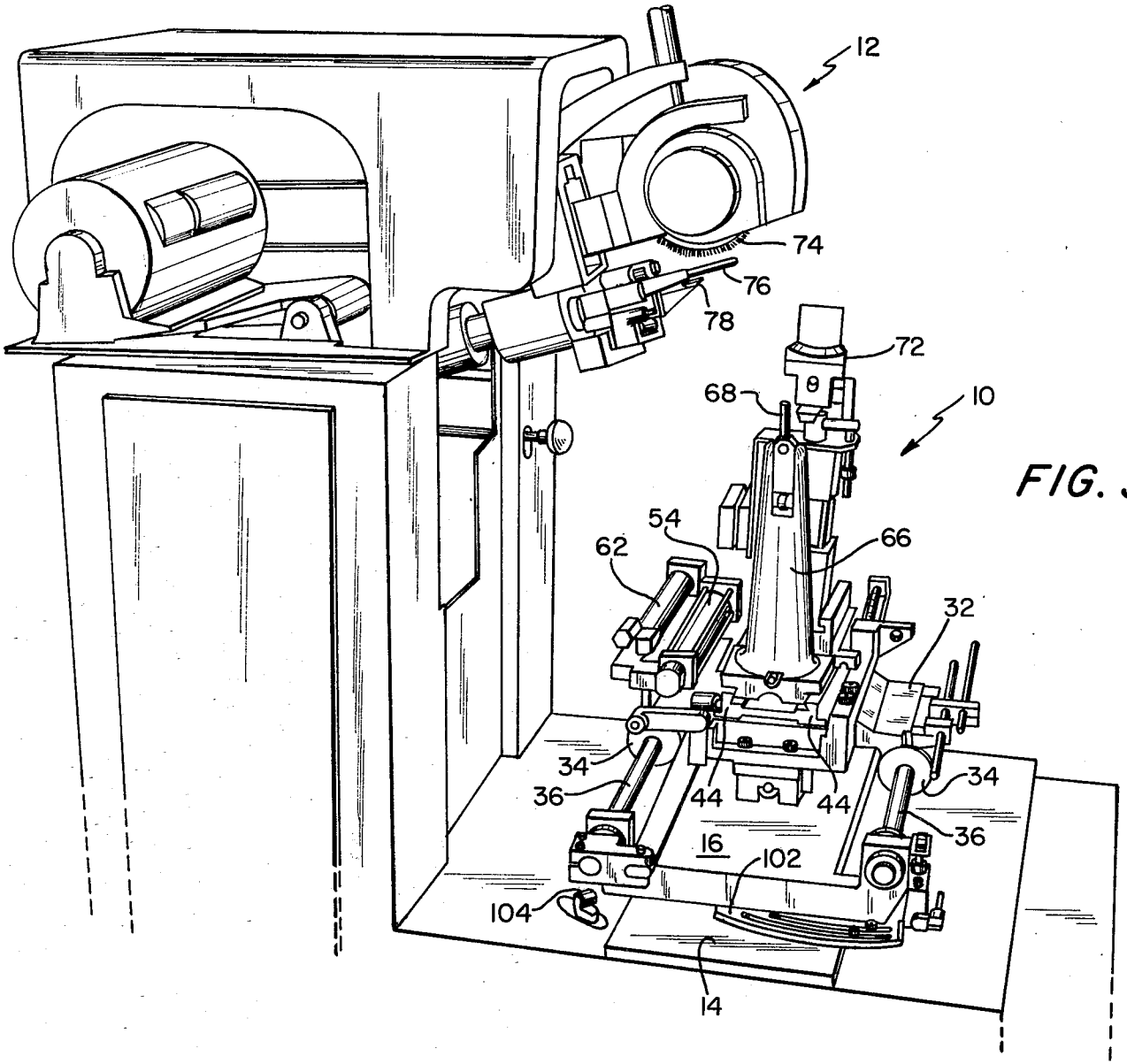

The machine, as shown in FIGS. 1-3, includes a shoe assembly mount section 10 and a tool section 12 located rearwardly of the section 10.

Referring to FIGS. 1-5, the shoe assembly mount section includes a stationary base 14. A turntable 16 is affixed to a spindle 18 that is rotatably mounted in a housing 20, the housing 20 being anchored to the base 14. A pinion 22 is rotable on the spindle 18 and is in mesh with a rack 24. The rack 24 is affixed to the piston rod 26 of a pneumatically operated motor 28. A one way clutch 30 is so connected to the spindle 18 and the pinion 22 that leftward movement (FIG. 4) of the rack 24 by the motor 28 causes 180 degree rotation of the spindle 18 and the turntable 16 and rightward movement (FIG. 4) of the rack 24 by the motor 28 does not cause rotation of the spindle 18 or the turntable 16.

Referring to FIGS. 1-3, 6 and 7, a carriage 32 is slidably guided on the turntable 16 for reciprocal movement in a horizontal plane between two end positions on the turntable by means of bushings 34 on the carriage 32 that are slidably guided on rods 36 affixed to the turntable 16. A pneumatically operated motor 38 has a piston rod 40 that is secured to a lug 42 of the carriage 32 to effect the reciprocal hotizontal movement of the carriage 32 along the turntable 16.

Figure 8:
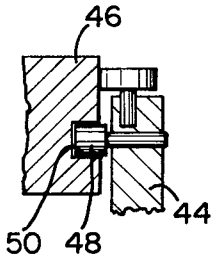
FIG. 8 is a section taken along the line 8—8 of FIG. 6.

Spaced arcuate upwardly concave guide elements 44 on the carriage 32 (see FIGS. 6 and 8) slidably guide a cradle 46 for arcuate movement along the guide elements 44 by means of rolls 48 on the guide elements 44 that are slidable in arcuate groves 50 in the cradle 46.

Figure 7:
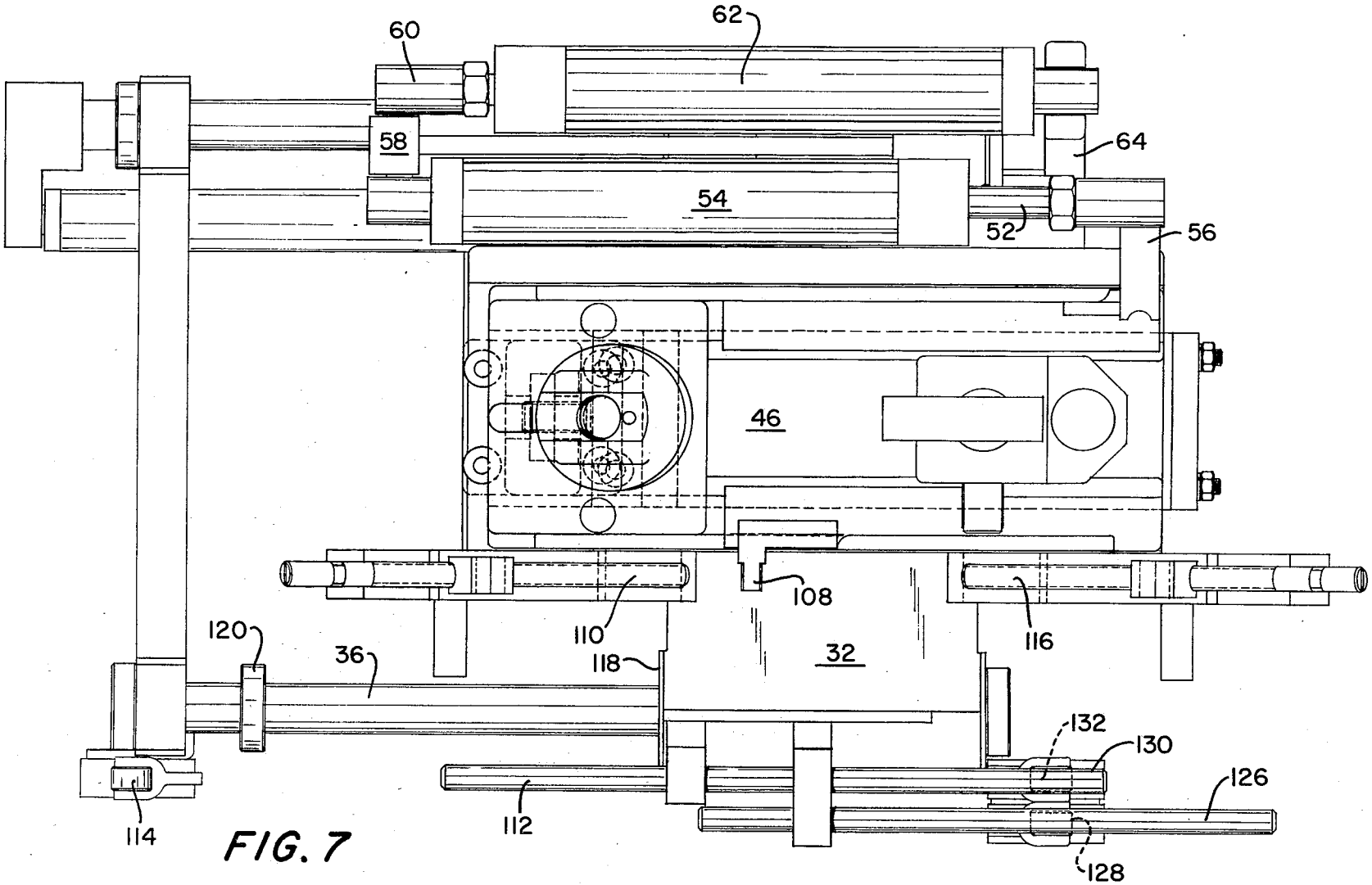
FIG. 7 is a plan view taken along the line 7—7 of FIG. 6.

Referring to FIG. 7, the piston rod 52 of a pneumatically operated motor 54 is pivoted to a lug 56 of the cradle 46. The head end of the motor 54 is pivoted to one end of a link 58. The other end of the link 58 is pivoted to the piston rod 60 of a pneumatically operated motor 62. The head of the motor 62 is pivoted to a lug 64 of the carriage 32.

A post 66, having a last pin 68 projecting upwardly thereof, is mounted to the cradle 46. A stand 70, having a toe pad 72 projecting upwardly thereof, is also mounted to the cradle 46. The last pin 68 and the toe pad 72 are spaced from each other lengthwise of the cradle 46.

Referring to FIGS. 1-3, the tool section 12 of the machine includes a roughing tool in the form of a rotatable wire brush 74. A margin sensor, that takes the form of a pair of fork tines 76, is mounted on opposite sides of the brush 74 and a side sensor 78 is located below the margin sensor 76. In the manner shown in U.S. Pat. No. 4,020,660:

a. The brush 74, the margin sensor 76 and the side sensor 78 are mounted for unitary heightwise and forward-rearward movement; and
b. The tool 74 is mounted for heightwise movement with respect to the margin sensor 76 and the side sensor 78.

In the idle condition of the machine: the piston rod 26 is retracted into the motor 28 and the turntable 16 is stationary; the piston rod 40 is retracted into the motor 38 to maintain the carriage 32 at one end of its path of horizontal movement along the turntable 16; the piston rod 52 is retracted into the motor 54 and the piston rod 60 is retracted into the motor 62 as indicated in FIG. 7; the last pin 68 is in substantial alignment with the axis of rotation of the turntable 16 about the axis of the spindle 18; and the brush 74, the margin sensor 76 and the side sensor 78 are caused to be in rearward and upper positions with the brush 74 elevated with respect to the margin sensor 76 and the side sensor 78 by mechanism shown in U.S. Pat. No. 4,020,660.

Figure 9:
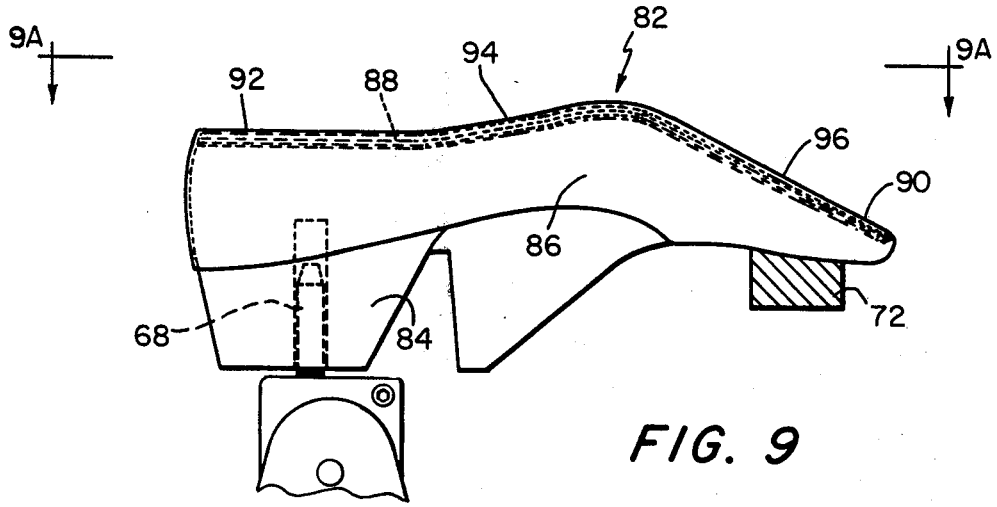
FIG. 9 is a representation of a shoe assembly mounted on the shoe assembly support.
Figure 9A:
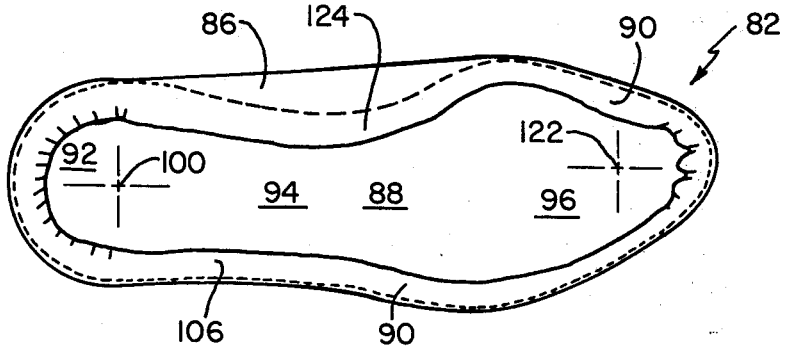
FIG. 9A is a view taken along the line 9A—9A of FIG. 9.

FIGS. 9 and 9A show a shoe assembly 82 that comprises a last 84 having an upper 86 mounted thereon and an insole 88 mounted on its bottom. The upper 86 has been lasted so that the upper margin 90 lies against and is secured to the insole and extends inwardly of the periphery of the insole and the last bottom.

In the manner shown in U.S. Pat. No. 4,020,660, the shoe assembly is supported on the last pin 68 and the toe pad 72 in the FIG. 9 position with the last pin 68 entered into the conventional thimble hole in the top of the heel portion of the last and the toe pad 72 supporting the top of the forepart portion of the shoe assembly. At this time the heel seat portion 92 of the shoe assembly bottom lies in a substantially horizontal plane, the shank portion 94 of the shoe assembly bottom slopes upwardly in a heel to toe direction, and the forepart portion 96 of the shoe assembly bottom slopes downwardly in a heel to toe direction.

Figure 10:
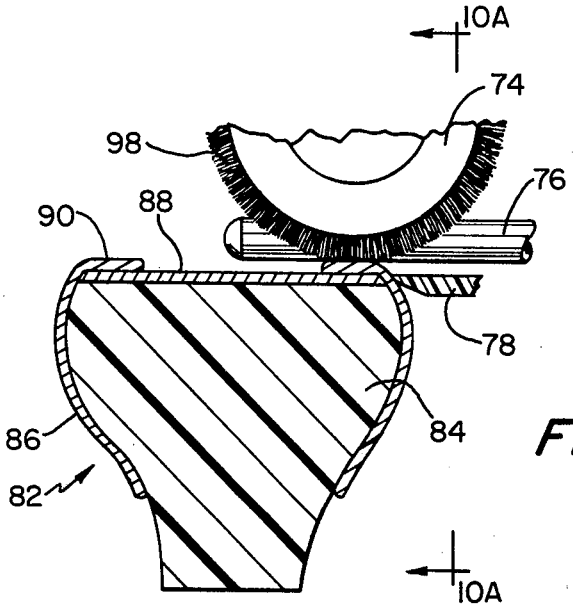
FIG. 10 is a representation of the shoe assembly being operated on by the roughing tool.
Figure 10A:
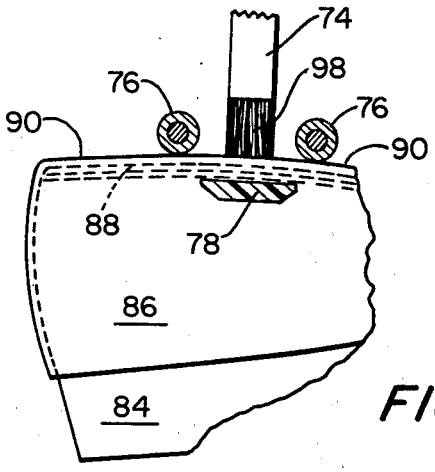
FIG. 10A is a view taken along the line 10A-10A of FIG. 10.

Now, in the manner shown in U.S. Pat. No. 4,020,660, the roughing tool 74, the margin sensor 76, and the side sensor 78 are so lowered and moved forwardly in unison as to cause the margin sensor 76 to engage one of the breast line portions of the upper margin 90 and as to cause the side sensor 78 to engage the corresponding side of the shoe assembly 82. The roughing tool 74 is then lowered with respect to the margin sensor 76 and the side sensor 78 until radially projecting bristles 98 engage the upper margin 90 between the tines of the margin sensor 76 as indicated in FIGS. 10 and 10A.

Figure 4:
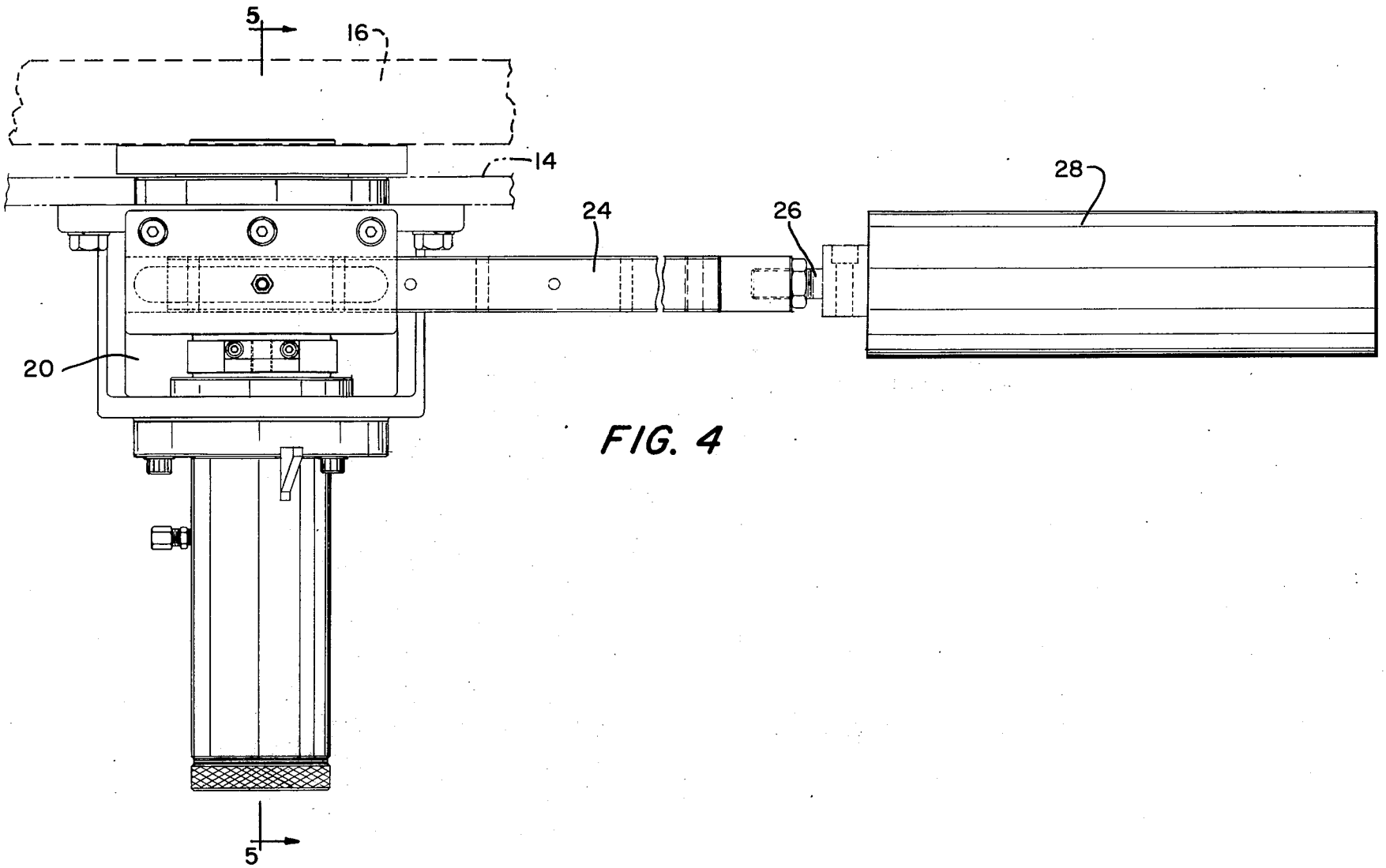
FIG. 4 is an elevation of a turntable rotating mechanism in the machine.
Figure 5:
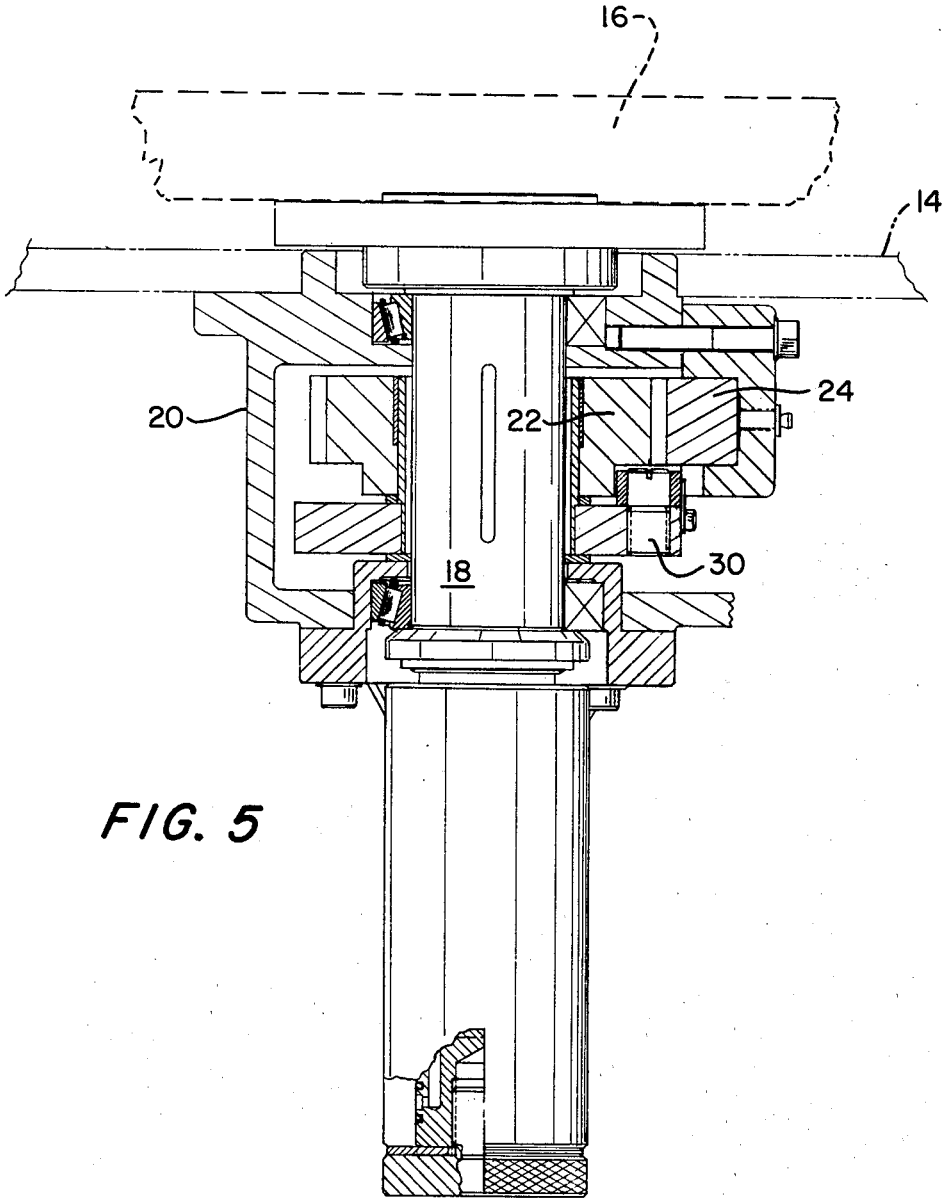
FIG. 5 is a section taken along the line 5—5 of FIG. 4.
Figure 6:
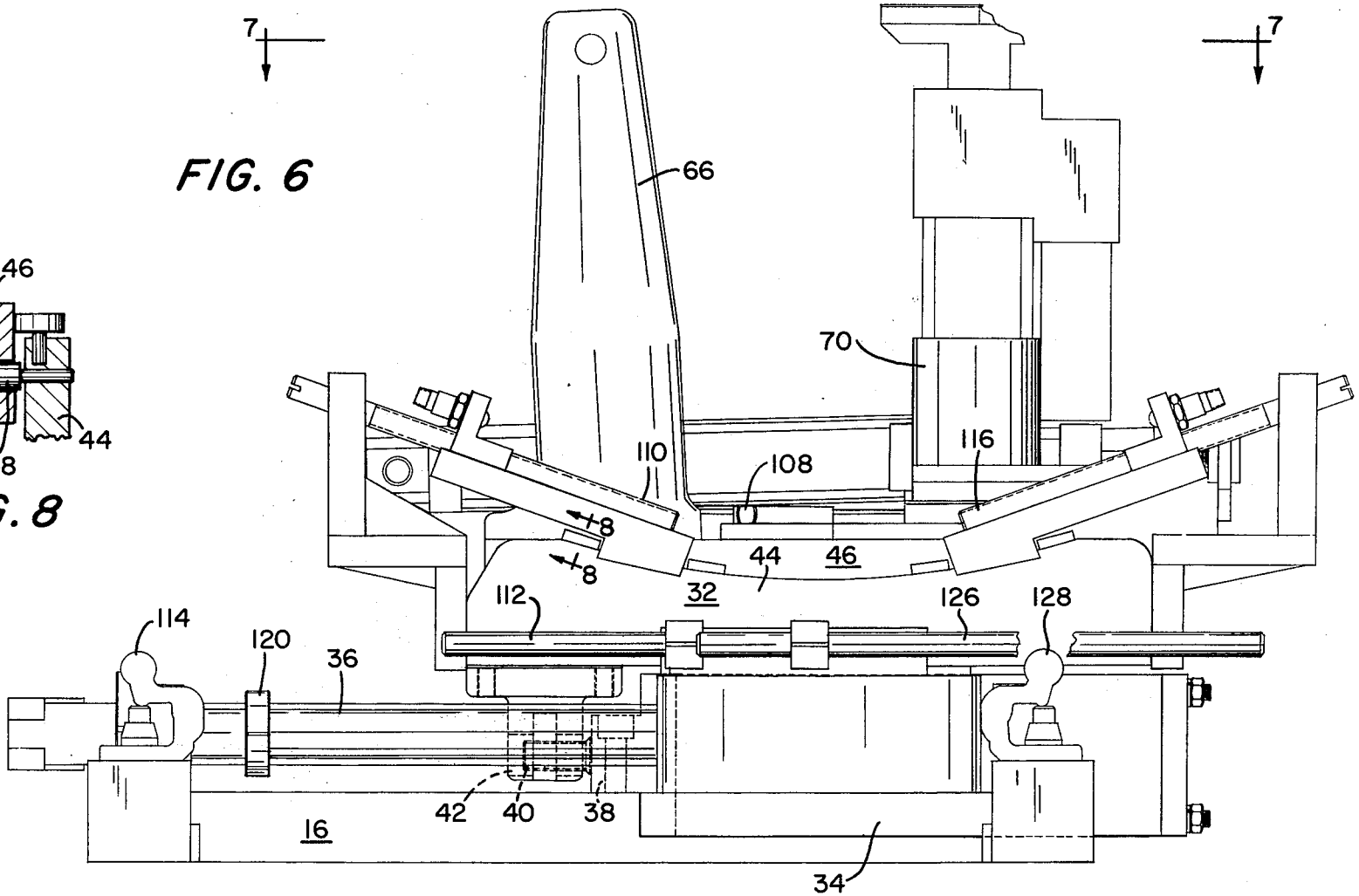
FIG. 6 is a side elevation of the shoe assembly support and of a carriage and a cradle that mount the shoe assembly support.

After this, the motor 28 is actuated to first project its piston rod 26 leftwardly and then retract its piston rod 26 rightwardly as seen in FIG. 4. The leftward movement of the piston rod 26, by means of the rack 24, the pinion 22, the one way clutch 30, and the spindle 18, causes the turntable 16 to rotate 180 degrees about the axis of the spindle 18 to thus rotate the carriage 32, the cradle 46 and the shoe assembly 82 180 degrees about the center that is approximately in alignment with the last pin 68 and that lies approximately at the center of curvature, indicated by number 100 in FIG. 9A, of the heel portion of the bottom of the shoe assembly 82. As a result, the heel portion of the upper margin 90 is swung past the rotating tool 74 and bristles 98 of the tool 74 abrade or rough the upper margin as the upper margin is moving past the tool.

During the movement of the heel portion of the upper margin 90 past the rotating tool 74, as well as the movement of the other portions of the upper margin past the rotating tool as described below, the tool must move upwardly and downwardly in accordance with the elevations of the upper margin portions being roughed and the tool must move forwardly and rearwardly so as to be positioned the desired distance inwardly of the outer periphery of the upper margin portions being roughed. These relationships are provided by the mechanisms shown in U.S. Pat. No. 4,020,660.

At the end of the 180 degree rotation of the heel portion of the shoe assembly 82 past the tool 74, a first cam (not shown) on a cam mount 102 (FIG. 3) on the turntable 16 intersects a valve 104 on the base 14. At this time, with the 180 degree rotation of the heel portion of the shoe assembly past the tool 74 completed, the tool 74 is located at one side 106 (FIG. 9A) of the upper margin 90 at the breast line and at the juncture of the heel seat portion 92 and the shank portion 94 of the shoe assembly bottom.

In response to the intersection of the first cam on the cam mount 102 with the valve 104, the piston rod 60 is projected out of the motor 62 while the piston rod 52 remains retracted in the motor 54 to thereby move the cradle 46 leftwardly (FIG. 6) along the guide elements 44 in the upwardly concave path defined by the guide elements 44 until a lug 108 (FIGS. 6 and 7) on the cradle 46 engages a rod 110 that is adjustably mounted to the carriage 32. This causes the shoe assembly 82 to be so swung that the shank portion 94 of the shoe assembly bottom lies in a substantially horizontal plane.

Also in response to the intersection of the first cam on the cam mount 102 with the valve 104, the motor 38 is actuated to project its piston rod 40 to thus linearly move the carriage 32 horizontally to thereby move the cradle 42 and the shoe assembly 82 linearly so that the tool 74 engages the first side 106 of the upper margin 90 as the shoe assembly 82 moves in a heel to toe direction past the tool 74 to thereby enable the tool 74 to rough the upper margin first side 106.

At about the time that the ball break on the upper margin first side 106, which forms the juncture between the shank portion 94 and the forepart portion 96 of the shoe assembly bottom, moves past the tool 74, a cam 112 (FIGS. 6 and 7), adjustably mounted to the carriage 32, intersects a valve 114 mounted to the turntable 16. The intersection of the cam 112 and the valve 114 so actuated the motors 54 and 62 as to cause the piston rod 60 to be retracted into the motor 62 to its idle position and to cause the piston rod 52 to be projected out of the motor 54 to thereby move the cradle 46 rightwardly (FIG. 6) along the guide elements 44 in the upwardly concave path defined by the guide elements 44 until the lug 108 engages a rod 116 that is adjustably mounted to the carriage 32. This causes the shoe assembly 82 to be so swung that the forepart portion 96 of the shoe assembly bottom lies in a substantially horizontal plane.

The lengthwise heel to toe movement of the shoe assembly 82 past the tool 74 continues until a stop 118 (FIG. 7) on the carriage 32 engages a ring 120 on one of the rods 36 at which point the axis of rotation of the turntable 16 is in substantial alignment with the center of curvature of the forepart portion of the shoe assembly bottom which is designated by number 122 in FIG. 9A.

Now the motor 28 is again actuated to reciprocate its piston rod 26, as described above, to again rotate the turntable 180 degrees, in the same direction as it was previously rotated, to thus rotate the carriage 32, the cradle 46 and the shoe assembly 82 180 degrees about the center of curvature 122 to thereby enable the forepart portion of the upper margin 90 to be swung past the roughing tool 74 and be roughed. At the conclusion of this 180 degree rotation, a second cam (not shown) mounted to the cam holder 102 and thus to the turntable 16 intersects a valve, similar to the valve 104, mounted to the base 14. Pursuant to this intersection, the motor 38 is actuated to return its piston rod 40 to its idle position to thereby move the second side 124 of the upper margin 90 past the tool 74 in a toe to heel direction to thereby enable the second upper margin side 124 to be roughed by the tool 74.

At about the time that the ball break on the second upper margin side 124, which is at the juncture between the shank portion 94 and the forepart portion 96 of the shoe assembly bottom, passes the tool 74, a cam 126 (FIGS. 6 and 7), adjustably mounted to the carriage 32, intersects a valve 128 mounted to the turntable 16. This intersection so actuates the motors 54 and 62 as to cause the piston rod 60 to be projected from the motor 62 and to cause the piston rod 52 to be retracted into the motor 54 to thereby again move the cradle 46 leftwardly in the carriage 32 in the upwardly concave path defined by the guide elements 44 until the lug 108 again engages the rod 110 to again so swing the shoe assembly 82 that the shank portion 94 of the shoe assembly bottom lies in a substantially horizontal plane.

At about the time that the shoe assembly completes its toe to heel movement, at which time the second upper margin side 124 at the juncture between the heel seat portion 92 and the shank portion 94 is in engagement with the tool 74, a cam 130 (FIG. 7) adjustably mounted to the carrier 32 intersects a valve 132 mounted to the turntable 16. This intersection actuates the motor 62 to retract its piston rod 60 to thus return the cradle 46 to its idle position wherein the heel seat portion 92 of the shoe assembly bottom 82 is in a substantially horizontal plane.

The roughing operation is now completed. The machine parts are now caused to return to their idle positions and the shoe assembly 82, with the roughed upper margin, is now removed from the machine.

As disclosed in U.S. Pat. No. 4,020,660, the tool 74 is rotated by a constant speed motor and is resiliently urged downwardly towards the shoe assembly bottom by a pneumatic motor during the movement of the upper margin 90 past the tool 74. In order for the tool 74 to uniformly rough the upper margin 90, it is desirable that the upper margin 90 be moved past the tool 74 at a uniform speed. During the linear heel to toe and toe to heel movements of the shoe assembly 82, the movements of the upper margin side portions 106 and 124 past the tool 74 are caused by the motor 38. Should an upper margin side portion slope upwardly as it moves linearly past the tool 74, the downwardly applied yieldable force of the tool against the margin creates a resistance to linear movement which slows down the rate of linear movement and thus causes the rotating tool to overrough the margin. Should an upper margin side portion slope downwardly as it moves past the tool 74, there is a diminution of the resistance to linear movement exerted by the tool against the upper margin so that the motor 38 tends to increase the rate of linear movement of the upper margin past the tool, thus causing the rotating tool to underrough the margin. In order to overcome these deficiencies and to enable all of the upper margin to move past the tool at a uniform speed, the upper margin portions are caused, by the mechanisms described above, to be in horizontal planes.

There follows a recipatulation of the description of those parts of the machine and its mode of operation that are germane to this invention.

The machine has the purpose of roughing the margin 90 of the upper 86 of the shoe assembly 82. The shoe assembly comprises the last 84 having the insole 88 located on its bottom and the upper 86 mounted thereon with the margin 90 of the upper so secured to the bottom of the insole 88 that the margin 90 and the insole 88 form the bottom of the shoe assembly 82. The shoe assembly bottom has spaced substantially planar end portions consisting of the heel seat portion 92 and the forepart portion 96 and the substantially planar shank portion 94 between the two end portions 92 and 96. The three planar portions lie in different planes.

The machine comprises a support formed of the last pin 68 and the toe pad 72 that supports the shoe assembly 82 bottom-up. The cradle 46 and the guide elements 44 mount the support 68,72 for rocking movement through an upwardly concave arc. The roughing tool 74 is located above the shoe assembly 82. Means shown in U.S. Pat. No. 4,020,660 yieldably urge the roughing tool 74 downwardly against the shoe assembly 82. Means comprised of the motors 28 and 38 so move the shoe assembly support 68,72 and means shown in U.S. Pat. No. 4,020,660 that includes the margin sensor 76 and the side sensor 78 so adjust the position of the roughing tool 74 that the upper margin 90 from one end of the shoe assembly bottom to the other end of the shoe assembly bottom moves past the roughing tool 74 and is roughed by the roughing tool with a first end portion, the shank portion 94 and the second end portion of the shoe assembly bottom moving successively past the roughing tool 74. The support 68,72 is movable through the upwardly concave arc between a first position in which said first end portion of the shoe assembly bottom lies in a substantially horizontal plane, a second position in which the shank portion 94 lies in a substantially horizontal plane, and a third position in which said second end portion lies in a substantially horizontal plane. The motor 54 with its piston rod 52 retracted therein and the motor 62 with its piston rod 60 retracted therein comprise means for initially retaining the support 68,72 in the first position. The intersection of the first cam on the cam mount 102 with the valve 104 causing the projection of the piston rod 60 out of the motor 62 comprises means effective pursuant to the movement of the support 68,72 when the juncture between the first end portion and the shank portion is in registration with the roughing tool to move the support 68,72 from its first position to its second position. The intersection of the cam 112 with the valve 114 causing the retraction of the piston rod 60 into the motor 62 and the projection of the piston rod 52 out of the motor 54 comprises means effective pursuant to the movement of the support when the juncture between the shank portion and the second end portion of the shoe assembly bottom is in registration with the roughing tool 74 to move the support 68,72 from its second position to its third position.

The aforementioned first end portion is the heel seat portion 92 of the shoe assembly bottom and the aforementioned second end portion is the forepart portion 96 of the shoe assembly bottom. The machine further comprises: the turntable 16 mounted for rotation about the vertical axis of the spindle 18; the carriage 32 mounted to the turntable 16 for linear horizontal movement between two carriage end positions defined by the retraction of the piston rod 40 into the motor 38 and the engagement of the stop 118 with the ring 120; the cradle 46 mounted to the carriage 32 for rocking movement through the aforementioned arc between two cradle end positions defined by the engagement of the lug 108 with the rods 110 and 116; and means formed by the post 66 and the stand 70 mount the support 68,72 to the cradle 46, the rocking movement of the cradle providing the movement of the support 68,72 through the aforementioned arc. The means for moving the support 68,72 as aforesaid comprises: means comprised of the retraction of the piston rod 40 into the motor 38 for initially locating the carriage 32 at the first one of the carriage end positions; means comprised of the motor 28 for thereafter rotating the turntable 16 180 degrees in a particular direction about the aforementioned vertical axis to move the heel portion of the upper margin 90 past the roughing tool 74; and means comprised of the motor 38 for thereafter horizontally moving the carriage 32 linearly from the aforementioned first carriage end position to the second carriage end position defined by the engagement of the stop 118 with the ring 120 to move a first side 106 of the upper margin 90 in a heel to toe direction past the roughing tool 74. The aforementioned means comprised of the motor 62 with its piston rod 60 retracted therein serves also to retain the cradle 46 in a central position spaced from the cradle end positions. The means formed by the intersection of the first cam on the cam mount 192 with the valve 104 to move the support 68,72 from its first position to its second position is operative pursuant to said 180 degree rotation of the turntable 16 to move the cradle 46 from its central position to a first of the cradle end positions. The means effected by the intersection of the cam 112 with the valve 114 to move the support 68,72 from its second position to its third position is operative pursuant to the linear horizontal movement of the carriage 32 to move the cradle 46 from its first cradle end position to its second cradle end position.

The means for moving the support 68,72 further comprises: means operative at the completion of the movement of the carriage 32 in the heel to toe direction to cause the motor 28 to again rotate the turntable 16 180 degrees in the same direction in which it had been previously rotated about the aforementioned verical axis to move the forepart portion of the upper margin past the roughing tool 74. After this, the motor 38 is actuated to return its piston rod 40 to its idle position, this acting as means to horizontally move the carriage 32 linearly from its second carriage end position to its first carriage end portion to move the second side 124 of the upper margin 90 in a toe to heel direction past the roughing tool 74. The intersection of the cam 126 with the valve 128 and the resultant actuations of the motors 54 and 62 to cause the piston rod 60 to be projected from the motor 62 and to cause the piston rod 52 to be retracted into the motor 54 forms means operative pursuant to the carriage movement in the toe to heel direction when the juncture between the forepart portion 96 and the shank portion 94 of the second side 124 of the upper margin 90 is in registry with the roughing tool 74 to move the cradle 46 from the second cradle end position to the first cradle end position. The intersection of the cam 130 with the valve 132 and the resultant actuation of the motor 62 to retract its piston rod 60 form means operative pursuant to the completion of the carriage movement in the toe to heel direction when the juncture between the shank portion 94 and the heel seat portion 92 of the second side 124 of the upper margin 90 is in registry with the roughing tool 74 to move the cradle 46 from the first cradle end position to the central position.

I claim:

1. A machine for roughing the margin of an upper of a shoe assembly, said shoe assembly comprising a last having an insole located on its bottom and the upper mounted thereon with the margin of the upper being secured to the bottom of the insole so that the margin and the insole form the bottom of the shoe assembly, said shoe asembly bottom having spaced substantially planar end portions consisting of a heel seat portion and a forepart portion and a substantially planar shank portion between the two end portions, said three planar portions lying in different planes, comprising: a support, for supporting the shoe assembly bottom-up, mounted for rocking movement through an upwardly concave arc; a roughing tool located above the shoe assembly; means for yieldably urging the roughing tool downwardly against the shoe assembly; and means for so moving the shoe assembly support and means for so adjusting the position of the roughing tool that the upper margin from one end of the shoe assembly bottom to the other end of the shoe assembly bottom moves past the roughing tool and is roughed by the roughing tool with a first end portion, said shank portion, and the second end portion of the shoe assembly bottom moving successively past the roughing tool; characterized in that the support is moveable through said arc between a first position in which said first end portion lies in a substantially horizontal plane, a second position in which said shank portion lies in a substantially horizontal plane, and a third position in which said second end portion lies in a substantially horizontal plane; and characterized in that the machine comprises; means for initially retaining the support in said first position; means effective pursuant to said support movement when the juncture between said first end portion and the shank portion is in registration with the roughing tool to move the support from said first position to said second position; and means effective pursuant to said support movement when the juncture between said shank portion and said second end portion is in registration with the roughing tool to move the support from said second position to said third position.

2. The machine of claim 1 wherein said first end portion is the heel seat portion of the shoe assembly bottom and said second end portion is the forepart portion of the shoe assembly bottom; further comprising: a turntable mounted for rotation about a vertical axis; a carriage mounted to the turntable for linear horizontal movement between two carriage end positions; a cradle mounted to the carriage for rocking movement through said arc between two cradle end positions; and means mounting the support to the cradle, the rocking movement of the cradle providing the movement of the support through said arc; wherein said means for so moving the support comprises: means for intitially locating the carriage at a first one of said carriage end positions; means for thereafter rotating the turntable 180 degrees in a particular direction about said vertical axis to move the heel portion of the upper margin past the roughing tool; and means for thereafter horizontally moving the carriage linearly from said first carriage end position to the second carriage end position to move a first side of the upper margin in a heel to toe direction past the roughing tool; characterized in that the means for initially retaining the support in said first position comprises means for retaining the cradle on the carriage in a central position spaced from said cradle end positions; the means to move the support from said first position to said second position comprises means operative pursuant to the completion of said 180 degree rotation of the turntable to move the cradle from its central position to a first of the cradle end positions; and the means to move the support from said second position to said third position comprises means operative pursuant to said linear horizontal carriage movement to move the cradle from said first cradle end position to the second cradle end position.

3. The machine of claim 2 wherein said means for moving the support further comprises: means operative at the completion of the carriage movement in said heel to toe direction to again rotate the turntable 180 degrees in said particular direction about said vertical axis to move the forepart portion of the upper margin past the roughing tool; and means for thereafter horizontally moving the carriage linearly from said second carriage end position to said first carriage end position to move the second side of the upper margin in a toe to heel direction past the roughing tool; characterized in further comprising: means operative pursuant to said movement in said toe to heel direction when the juncture between said forepart portion and said shank portion is in registry with the roughing tool to move the cradle from said second cradle end position to said first cradle end position; and means operative pursuant to the completion of said movement in said toe to heel direction when the juncture between said shank portion and said heel seat portion of the second side of the upper margin is in registry with the roughing tool to move the cradle from said first cradle end position to said central position.

* * * * *

UNITED STATES PATENT AND TRADEMARK OFFICE

CERTIFICATE OF CORRECTION

PATENT NO. : 4167103

DATED : September 11, 1979

INVENTOR(S) : Michael M. Becka

It is certified that error appears in the above-identified patent and that said Letters Patent are hereby corrected as shown below:

Under item 56 of the cover sheet, change the number and the name of the patentee of the first listed patent document respectively from "2,163,031" to --3,163,031-- and from "Kostell" to --Kestell--.

Signed and Sealed this

*Fourth* Day of *December 1979*

[SEAL]

*Attest:*

SIDNEY A. DIAMOND

*Attesting Officer*

*Commissioner of Patents and Trademarks*